United States Patent [19]

Reinhart

[11] Patent Number: 4,858,264

[45] Date of Patent: Aug. 22, 1989

[54] ULTRASONIC ASSISTED PROTECTIVE COATING REMOVAL

[75] Inventor: Theodore J. Reinhart, Dayton, Ohio

[73] Assignee: The United States of America as represented by the Secretary of the Air Force, Washington, D.C.

[21] Appl. No.: 253,994

[22] Filed: Oct. 5, 1988

Related U.S. Application Data

[63] Continuation-in-part of Ser. No. 902,554, Sep. 2, 1986, abandoned.

[51] Int. Cl.[4] ..... A47L 13/08

[52] U.S. Cl. ..... 15/93 R; 15/236.1; 51/59 SS; 51/DIG. 11; 74/1 SS; 156/344

[58] Field of Search ..... 15/22 R, 93 R; 51/59 SS, DIG. 11; 74/1 SS; 84/DIG. 24; 156/344; 310/323, 325

[56] References Cited

U.S. PATENT DOCUMENTS

| | | | |
|---|---|---|---|
| 2,651,148 | 9/1953 | Carwile | 51/59 |
| 2,848,672 | 8/1958 | Harris | 318/118 |
| 2,947,886 | 8/1960 | McGunigle | 310/8.3 |
| 2,990,616 | 7/1961 | Balamuth et al. | 32/26 |
| 3,195,232 | 12/1962 | Toth | 30/169 |
| 3,342,076 | 9/1967 | Bodine | 74/87 |
| 3,368,280 | 2/1968 | Friedman et al. | 32/58 |
| 3,584,327 | 6/1971 | Murray | 104/16 |
| 3,618,786 | 11/1971 | Fick | 214/1 CM |
| 3,619,671 | 11/1971 | Shoh | 310/8.2 |
| 3,623,909 | 11/1971 | Jones | 134/5 |
| 3,754,448 | 8/1973 | McDaniel | 90/24 |
| 3,809,977 | 5/1974 | Balamuth et al. | 318/116 |
| 3,980,906 | 9/1976 | Kuris et al. | 310/8.1 |
| 4,182,000 | 1/1980 | Fairbairn | 15/236 B |
| 4,380,478 | 4/1983 | Cooney | 134/38 |
| 4,398,961 | 8/1983 | Mason | 134/19 |
| 4,401,476 | 8/1983 | Klaiber | 134/33 |
| 4,413,910 | 11/1983 | Cornu et al. | 356/377 |
| 4,443,271 | 4/1984 | Goerss | 134/34 |
| 4,466,851 | 8/1984 | Hoffman | 156/344 |
| 4,546,724 | 10/1985 | Kiryu et al. | 118/669 |
| 4,604,715 | 8/1986 | Toutant et al. | 364/513 |

FOREIGN PATENT DOCUMENTS

| | | | |
|---|---|---|---|
| 758631 | 10/1956 | United Kingdom | 74/1 SS |
| 2032221 | 4/1980 | United Kingdom | 310/325 |

*Primary Examiner*—Chris K. Moore

*Attorney, Agent, or Firm*—G. B. Hollins; Donald J. Singer

[57] ABSTRACT

A paint or other protective coating removal arrangement involving the use of reciprocal motion ultrasonic frequency mechanical energy applied to the coating by a variety of tool and abrasive substrate members in the company of surface preparation agents such as coolant, heating, softening, and/or abrasive agents. The invention is particularly applicable and disclosed in terms of protective coating removal from aircraft, such as is often necessary for replacement or in the reutilization of aircraft with different identification markings. The coating removal arrangement is environmentally and human operator safe in comparison with presently used coating removal arrangements such as abrasive blasting and chemical solvent removal.

20 Claims, 3 Drawing Sheets

ULTRASONIC ASSISTED PROTECTIVE COATING REMOVAL

RIGHTS OF THE GOVERNMENT

CROSS REFERENCE TO RELATED APPLICATIONS

This application is a continuation in part of applications serial number 06/902,554 now abandoned; a divisional application of the 06/902,554 application also exists as serial number 07/070,499. The disclosure of the 07/070,499 divisional application is hereby incorporated by reference herein.

The invention described herein may be manufactured and used by or for the Government of the United States for all governmental purposes without the payment of any royalty.

BACKGROUND OF THE INVENTION

This invention relates to the field of paint or other protective coating removal from structures such as aircraft.

Protective coatings are used for a variety of functions on vehicles such as aircraft. In such service, the protective coating provides immunity to oxidation or corrosion, provides thermal insulation and shielding, and is a major tool for appearance enhancement and the provision of camouflage and identification, as well as providing optical and electrical signature control.

During the life of a painted or coating protected object, hereinafter referred to typically as an aircraft, the applied coating often requires removal for a variety of reasons, including replacement of worn and weathered coating materials repair (local), and changes in the appearance, camouflage or identification of the aircraft—such as might occur in the sale of an operational U. S. Air Force aircraft to a friendly foreign nation as part of an arms agreement. The removal of present-day coatings from weapons systems is, however, quite labor intensive and often requires the use of highly activated physical and chemical materials.

Coating removal technology has, at the present time, lagged the development of new polymeric resins in the protective coating art. In the past when alkyd primers, alkyd topcoats and acrylic nitrocellulose topcoats or earlier developed substances were used as aircraft coating materials, their removal was readily accomplished with solvent-based strippers which employed, for example, methylene chloride as a major component. However, as coatings have changed from alkyds and nitrocellyloses to epoxies, polyurethanes, and fluoropolymers, such traditional solvent-based strippers have become inefficient or ineffective in coating removal, as well as being on the OSHA/EPA toxic materials listing.

Presently used coatings moreover have a useful life expectancy of 5–7 years as a result of their environmental, erosion, and fluid resistance characteristics. Such life is in notable contrast with a functional life of about two years for the alkyd and acrylic nitrocellulose coatings previously used. The continued polymerization and aging of these newer coatings throughout their life and their resulting increased resistance to chemical stripping materially adds to the difficulty of coating removal. These coatings therefore are often capable of enduring beyond the first usage period of a weapon system.

The chemical industry has provided improved strippers for use with the presently-used coatings by adding activating agents to the traditional solvent stripper solutions. Commonly used activators include phenols, chlorinated phenols, and amine compounds. However, in addition to being unable to effectively and economically remove epoxy and polyurethane coatings, such compounds are found to pose human health risk and have therefore become substances that are regulated by environmental protection agencies and occupational safety and health agencies of the federal and state governments. Phenol-activated strippers are the most effective of these groups, but often require as many as five stripping applications. Such strippers are particularly undesirable in that phenol compounds are biodegradable only with a difficulty and therefore can cause especially difficult environmental pollution when used in significant quantities. The addition of hexavalent chromium compounds to these strippers as a corrosion inhibiting agent further restricts the use of such strippers from an environmental viewpoint.

Chemical paint strippers are also inappropriate for the removal of protective coatings from the non-metallic organic matrix composite materials how being used in aircraft structures—materials such as epoxy impregnated woven graphite filament fabric. Chemical paint strippers cannot be used for paint removal from such composite materials because of the high risk of the stripper chemically attaching organic components of the material.

Mechanical coating removal by abrasive blasting is one current alternative to the ue of chenical stripping. Such abrasive media as crushed corn cobs, glass beads, plastic beads, walnut shells, synthetic diamond dust, garnet particles, and dry ice carbon dioxide pellets have been employed in abrasive blasting removal rocesses. High pressure fluids such as water have also been used in this type of coating removal. All of these techniques have, however, met with such limited success, that a cost-effective and safe arrangement for removing protective coatings, particularly from aircraft structures is yet a pressing present day need.

The use of plastic beads in abrasive blasting coating removal from aircraft structures and the status of coating removal technology in general is described in a technical report titled "Evaluation of the Effects of a Plastic Bead Paint Removal Process on Properties of Aircraft Structural Materials" published by the Materials Laboratory, Air Force Wright Aeronautical Laboratories, Air Force Systems Command, Wright-Patterson Air Force Base, Ohio, 45433, and identified as report number AFWAL-TR-85-4138 dated December 1985. Copies of this report are available from the publishing organization and also from the National Technical Information Service. The contents of the December 1985 AFWAL report is hereby incorporated by reference herein.

As described in the AFWAL December 1985 report, the use of abrasive blasting techniques as an alternate to chemical stripping in metal-skinned and organic matrix composite skinned aircraft raises a number of concerns as to possible undesired side effects of abrasive blasting on the airframe, including the following:

a. Surface roughness and its potential effects on aerodynamic drag;
b. Fatigue properties of cleaned metal alloys as a result of the induced surface roughness;
c. Removal of protective metal coatings such as aluminum alloy layers and cadmiun plating from steel structure;

d. Effects on the bond strength of aluminum honeycomb and thin skin aluminum metal-to-metal bonded structure.
e. Effects on the physical properties of graphite/epoxy composite materials;
f. Intrusion of the particulate matter on the wear properties of lubricated bearings in the airframe and consequent effects;
g. Thin skin warpage as a result of surface cold working;
h. Effects on fatigue crack growth rate as a result of compressive residual stress on the surface and tensile residual stress in subsurface material;
i. Effects on dye penetrant inspection techniques; and
j. Intrusion of blast particles into avionic compartments.

The patent art also discloses the attention of inventors to arrangements for removing paint and other protective coating materials. This attention is evidenced by the patent of J. V. Jones, U.S. 3,623,909, which concerns an electrically heated tool and a method for using the tool in paint removal. Also included in this art are the patents of H. F. Fairbairn, U.S. 4,182,000 which concerns a hand held scraper-sander, B. K. Hoffman, U.S. 4,466,851 which concerns a hand held scraper that is especially suited for removing fragments of a gasket from automobile engine components and P. Toth, U.S. 3,195,232 which concerns a stripping device suitable for wall paper removal.

Additionally included in this art is the patent of R. R. Mason, U.S. 4,398,961, which concerns a fuel combustion heated device and method of use thereof for removing old paint. Also included in this art is the patent of W. G. Goerss, U.S. 4,443,271, which concerns an apparatus and method used for cleaning floor grates employing high-pressure water jets.

Further included in this art is the IBM Technical Disclosure Bulletin Vol. 21, No. 7, dated December 1978, entitled "Stripping Procedure for High-Energy and Ion-Bombarded Resists", authored by L. H. Kaplan and S. M. Zimmerman which concerns the removal of resist material layers that have become hard and glossy after high-energy implantation processes and wherein a combination of hot concentrated nitric acid at a temprature of 80° to 120° C., and ultrasonic agitation are employed. The Kaplan and Zimmerman disclosure bulletin includes a possible inference that stripping is accomplished in an ultrasonic agitated bath of nitric and phosphoric acids.

In addition, the use of vibrational energy is well known in the patent art as is evidenced by the patents of E. J. Murray, U.S. 3,584,327 which concerns an ultrasonic energy transmission system, L. Balamuth et al, U.S. 3,809,977 concerning an ultrasonic tool kit and motor, A. G. Bodine, U.S. 3,342,076 which concerns a sonic frequency resonator of the pressurized fluid energized type. In addition, the patents of E. C. McDaniel, U.S. 2,651,148; W. T. Harris, U.S. 2,848,672; R. D. McGunigle, U.S. 2,947,886; L. Balamuth et al, 2,990,616; C. M. Friedman, U.S. 3,368,280; A. Shah, U.S. 3,619,671; R. C. McDaniel, U.S. 3,754,448; Akuris et al, U.S. 3,980,906, G. Bradfield, U.K. 758,631, and A. E. Crawford, U.K. 2,032,221; show a variety of sonic and ultrasonic tools that are uable in dental settings for example.

It is, of course, also well known in the art to employ ultrasonic agitation of a container filled with a solvent or chemical reagent for cleaning purposes. Apparatus of this type has been commercially available and used, for example, in the cleaning of jewelry and in the cleaning of electronic parts. Ultrasonic energy has also been used for welding and industrial melting fusion arrangements such as in the fabrication of built-up assemblies from plastic component parts.

It may be noted that none of these examples is concerned with the use of ultrasonic energy for the removal of paint or protective coatings from damage-susceptible surfaces such as the exterior of an aircraft.

SUMMARY OF THE INVENTION

In the present invention, mechanical energy of a reciprocating or vibratory nature, with the vibrations occurring in the ultrasonic frequency range, is employed to assist in the removal of protective coatings from aircraft and other objects. The invention contemplates both the use of an excited scraping tool and energized abrasive particles as a delivery means for the ultrasonic energy. The disclosed ultrasonic energy apparatus has been found to be significantly improved in coating removal ability with respect to previous vibrating tool apparatus.

An object of the invention is therefore to provide an ultrasonic energy assisted protective coating removal arrangement.

It is another object of the invention to provide coating removal apparatus which operates with significantly lower energy input—energy levels an order of magnitude decreased from that of comparable lower frequency apparatus.

It is another object of the invention to provide a viscoclastic coating removal apparatus which achieves increased apparent hardness in the removed coating material.

It is another object of the invention to provide a coating removal apparatus which operates with significantly reduced displacement amplitude with respect to normally used removal apparatus.

It is another object of the invention to provide an ultrasonic coating removal arrangement wherein assisting media such as temperature change fluids or chemical softening agents can be employed.

It is another object of the invention to provide a protective coating removal arrangement which is subject to use in both small scale and large scale environments.

It is another object of the invention to provide a protective coating removal arrangement which is suitable for use in combustible or other hazardous environments.

It is another object of the invention to provide a coating removal arrangement which is safe for use with respect to the environment and with respect to human operators.

Additional objects and features of the invention will be understood from the following description and the accompanying drawings.

These and other objects of the invention are achieved by a protective coating removal apparatus for a physcial damage susceptible aircraft surface covered with a coating layer to be removed comprising: transducer means for generating reciprocal motion mechanical energy of at least twenty kilohertz ultrasonic movement frequency; a coating engagement tool physically connectable with a mechanical energy output portion of the energy transducer means at one tool end and receivable at the opposite tool end on the damage susceptible aircraft surface in ultrasonic energy transferring mechanical engagement with the coating layer and in sliding relationship with the aircraft surface; and moving means responsive to one of the coating layer presence indicators of scraping tool resistance force and optical energy reflection difference between the paint coating and the aircraft surface for moving the ultrasonic frequency mechanical energy excited coating engagement tool over the surface of the aircraft in engagement with successive portions of the coating layer.

DETAILED DESCRIPTION

Concern for the effects of a paint or protective coating removal sequence on the structural integrity and other functional aspects of modern-day aircraft are very real. In the case of both the F-15 aircraft shown in FIG. 1 and the proposed organic matrix composite elements to be increasingly employed in future aircraft such as B-2 and ATF, the abrasive blast coating removal concerns recited above and other aspects of coating removal are, for example, the subject of ongoing formal technical investigations seeking an optimum coating removal arrangement.

When aircraft that employ conventional metallic surface materials such as the popular Alclad 7075-T6 clad aluminum are subjected to plastic bead coating removal in accordance with present day coating removal practices, it is not unusual to have the aircraft surface incur a significant degree of physical damage. This damage may include erosion of the cladding layer to a severe degree, with pitting, thinning and cracking effects attending the erosion. In the high speed and high structural loading environment of a modern military aircraft, surface which have been damaged to this degree are unacceptable. Moreover, when the newer organic matrix composite materials are employed in aircraft surfaces an abrasive blast coating removal sequence can result in the cutting of matrix filaments and heavy disruption of the epoxy filling between filaments; damage of this type is also too severe to be acceptable.

Figure 1:
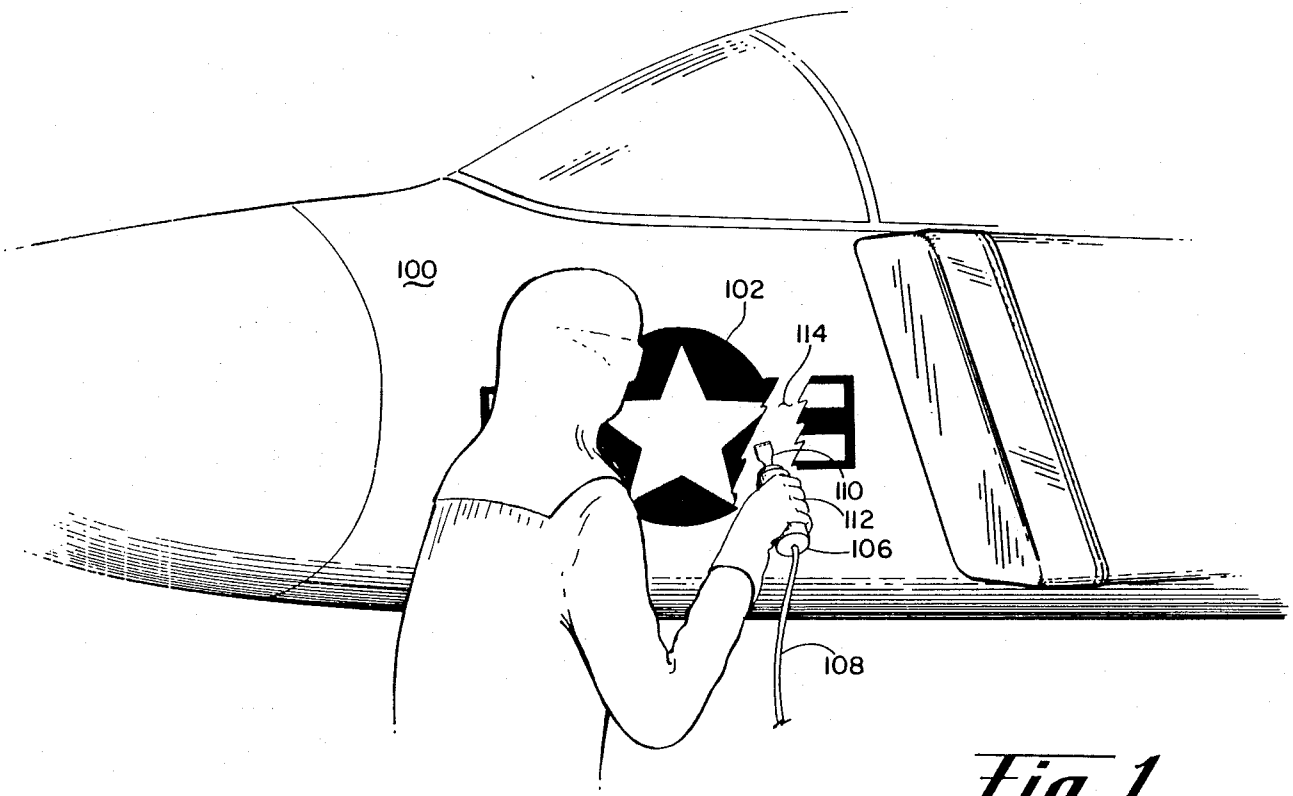
FIG. 1 shows apparatus to the invention used to remove an insignia area portion of the protective coating from an aircraft.

The prospect of surface damage from abrasive blasting and the unsuitability of chemial stripping agents for use in modern-day aircraft coating removal operations clearly indicates the need for an improved stripping arrangement, an arrangement as shown in FIG. 1 of the drawings for example.

In FIG. 1, one aircraft currently used by the U.S. Air Force, an F-15 fighter, is shown undergoing a small area protective coating removal procedure wherein one of the aircraft markers, a cockpit adjacent insignia 102 is being removed. Such removal would be accomplished, for example, if the aircraft were being transferred to a friendly nation, or being refurbished and is exemplary of a removal arrangement that is usable on a larger scale over the entire aircraft. In the FIG. 1 drawing, a human operator 104 is shown using an ultrasonic kinetic energy tool 110 for removing the insignia 102, as is indicated by the removed area 114.

In the FIG. 1 coating removal arrangement, the tool 110 is excited with ultrasonic reciprocating motion by a transducer 106 held in the operator's hand 112. The tool 110 is energized by an energy source that is not shown in FIG. 1, but is tethered to the transducer 106 by the flexible conduit 108. Preferably, the transucer 106 is of the electrical energy to mechanical energy type and may be of the of the transducer type disclosed in or or more the above referred to U.S. Patents 3,980,906; 3,809,977; 3,754,448; 3,619,671; 3,584,327; 3,368,280; 2,990,616; 2,947,886; 2,848,672; 2,651,148, and U.K. 758,631 and 2,032,221 which are incorporated by reference herein. The transducer 106 may also operate in conjunction with a transistorized or solid-state electronic power converter apparatus connected to the transducer 106 by way of an electrical cable embodiment of the flexible conduit 108.

Electrically operated transducers of the FIG. 1 type are also commercially available in embodiments having input energy levels ranging upward from 400 watts. One apparatus of this type is the Sonicator Heat Systems Inc. ultrasonic generator and transducer which is manufactured by Sonicator Systems, Inc. of Newark, New Jersey. The Sonicator transducer is of the barium type and operates at a power level of about 750 watts delivered to the transducer. The Sonicator apparatus operates at an ultrasonic frequency of 50 kHz. Larger ultrasonic systems, systems operating in the range of 5 to 10 kilowatts of input energy or more, are commercially available and are, of course, desirable for large surfaces of an aircraft or other extended area structures. Generally, transducers which provide mechanical energy output at a frequency of twenty kilohertz and above are considered to be ultrasonic a nature. Ultrasonic transducers which are energized by compressed air, pressurized hydraulic fluid or other pressurized fluid sources of energy are disclosed in the above referred to U.S. Patent 3,742,076 and are considered to be within the scope of the invention. With such larger transducers, mechanically-supported and machine-guided arrangements such as robotic devices which can be programmed for the stripping of a predetermined shape and area may be desirable.

Figure 4:
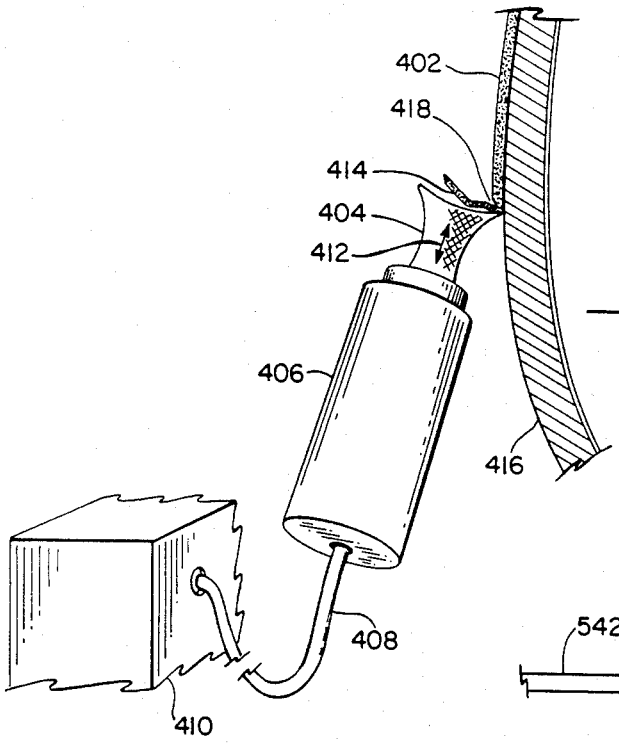
FIG. 4 shows a hand-held tool arrangement of the invention.

FIG. 4 in the drawings provides additional details of a hand-held arrangement of the invention. In FIG. 4, an aluminum exterior surface portion of an aircraft 400 is shown in the process of having a protective coating 402 removed. In the FIG. 4 arrangement, a tool 404 may have a square or blunt edge 414 that is disposed at an angle enabling energy transferring engagement of the coating 402.

Figure 5:
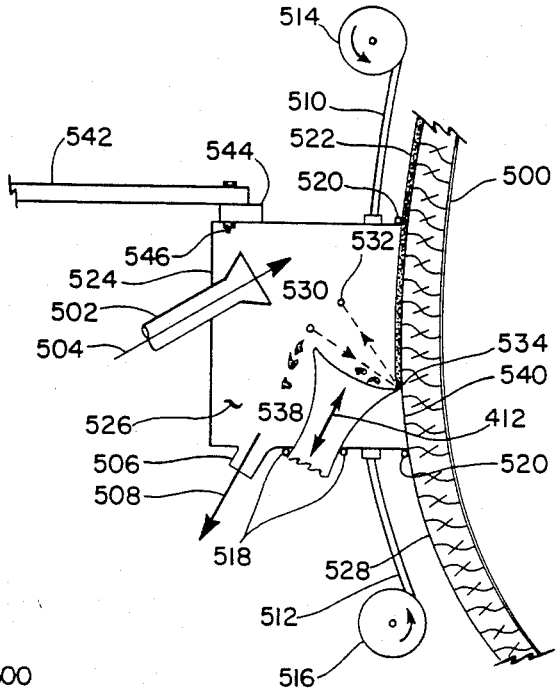
FIG. 5 shows a machine positioned embodiment of the invention and also provision for the addition of assisting agents to the coating removal process.

The tool 404 in FIG. 4 is energized in the reciprocal or vibratory axial motion fashion indicated at 412. Such motion is intended to achieve both sliding, non-engaging and non-damaging tool movement over the aircraft surface 416, along with energy-transferring compression, impacting, shearing, and other destructive engagement with the coating 402 in a contact region 414. The square or blunt edge embodiment of the tool 404 as shown in FIGS. 4 and 5 of the drawings is one plausable arrangement for a coating engagement tool for the instant invention. As is illustrated, for example, by the end portion of a mill file that has been ground clean and square on a grinding wheel or by the square edge of a broken plane of glass, such square edge tool arrangements can, indeed, be effective as coating engagement and removing tool devices. The very fine or even microscopic feather edge which often results from a grinding or glass breaking act often, in fact, enhances the coating removal capability of such square edge tools and can also provide an effective cutting device - as is often painfully apparent to perious working with such materials. When used in the present invention, apparatus, such tools are to be held at a small angle with respect to the metal surface in order that the tool edge slide freely and without energy loss over the metal surface but engage the coating material in a substantially head on arrangement that imparts ultrasonic energy to the coating material.

Figure 2:
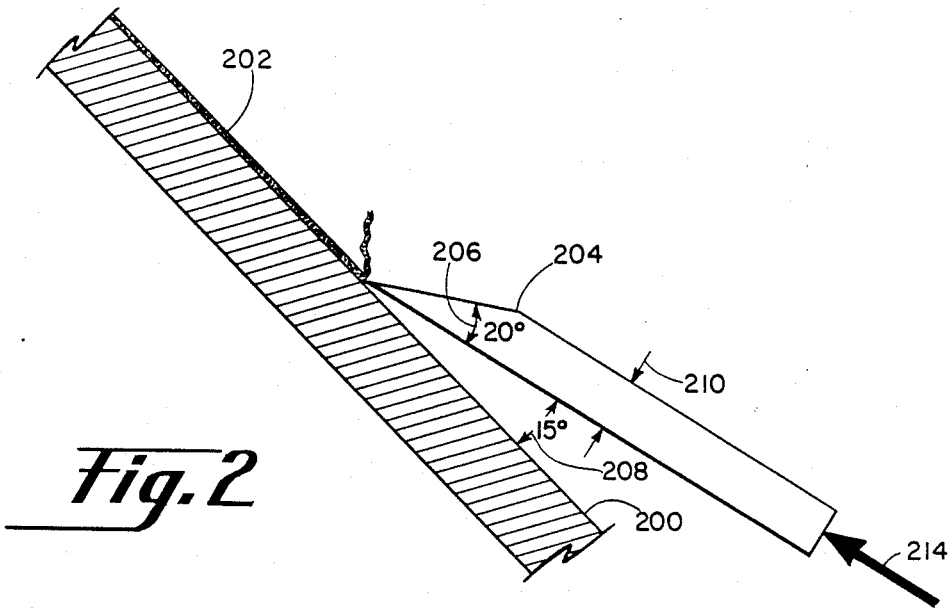
FIG. 2 shows a preferred blade arrangement and blade disposition for use in the invention.

Another tool embodiment usable in the FIGS. 4 and 5 coating removal sequences, in fact, an embodiment that is to be preferred, is shown in FIG. 2 of the drawings. In the FIG. 2 drawing, the tool 204 is shown to include pointed and sharpened working edge portion 212 which subtends an angle 206 that is in the order of twenty degrees in size. The body of the FIG. 2 tool may be in the range of 0.050 inch in thickness as is indicated at 210. The relatively thin body portion and the twenty degree taper to the tool working edge 212, in fact, give the FIG. 2 tool a razor blade like appearance. During use, the tool 204 is energized with vibrational energy motion as is indicated at 214 in FIG. 2 and is preferably disposed at an angle 208 with respect to the coated surface; the angle 208 is in the range of five to twenty-five degrees in size. An angle in the middle of this range, i.e. an angle of fifteen degrees is shown in FIG. 2.

Displacement amplitudes of one thousandth of an inch or even less are found to be satisfactory for the ultrasonic energy motion 214; this motion amplitude is notably smaller than the ten thousandths of an inch to one hundred thousandths of an inch amplitude usually needed with sonic frequency or lower frequency removal tool energizations. The low amplitude ultrasonic energization is also conducive to non engagement sliding of the tool working edge over the surface 200 that is being cleaned.

It is notable that the coating material 200 being removed in the FIG. 2 arrangement of the invention, is frequently found to be responsive to ultrasonic energy tool energization in an unexpectedly favorable manner. Even though the material being removed is often an intentionally tenacious substance such as polyurethane or the above-identified epoxy or fluoropolymer coating, it is often noted that in the presence of ultrasonic frequency coating removal techniques, such materials display a surprising brittle behavior. An increased brittle behavior is, of course, found to be decidedly better for removal purposes than is the viscoelastic response normally displayed by these and other coating materials. In particular, viscoelastic materials are rate sensitive so that the higher rates of loading as achieved with the ultrasonic energy removal procedures described herein causes these materials to act in a brittle manner.

A uniquely effective energy transfer is also achieved between the working edge portion 212 of an ultrasonic energy excited tool 204 and the coating 202. This increased energy transfer is demonstrated by the increased rate of loading—a loading increase observed when similar tools that are energized with subsonic or sonic frequency energy are contrasted with the present ultrasonic frequency energy excited tools. This enhanced energy transfer is also manifest in thermal darkening of the removed coating and thermal dulling of the tool working edge 212 in the case of ultrasonic energy excitation. The duration of the elevated temperature is found to be relatively short—on the order of one millisecond, however, tool working edges made of carbide or diamond materials are desirable with the ultrasonic frequency energization in order to achieve practical tool life in a working environment in the presence of expected elevated tool temperatures. Infrared motion pictures or video camera images as are known in the imaging art, can be used to quantify the times, temperatures, and precise nature of the tool and coating heating and optimize its utility in the coating removal process.

In view of the more effective energy transfer to the removed coating by the tool 204 when ultrasonic energy energization is used, it is found that significantly lower total energy input to the removal process will yet provide desirable coating removal action. Energy input levels decreased by an order of magnitude from those required with sonic or subsonic frequency energized removal apparatus are, in fact, found to be satisfactory in the case of the described ultrasonic energy energization.

In the case of ultrasonic frequency tool energization, it is also found that relatively little force is required for urging the energized tool 204 or 404 into contact with the receding edge of the coating being removed. In most instances this urging requires no more than simple maintenance of physical contact between the ultrasonic frequency vibrating tool and the receding coating edge. In the case of robotic or automatic feeding of the tool or workpiece as described below and in FIG. 5 of the drawings, these low urging forces enable a desirable simplification and downsizing of the feed apparatus used.

The urging force applied to the transducer in FIG. 5 is of course, to be distinguished from the vibrational force at ultrasonic frequency that is generated by the transducer. The urging or travel force is a unidirectional force applied to the transducer and is opposed in F=MA fashion by the combined mass of the tool and transducer and also by the tool working edge meeting the edge of the coating 402 or 522—i.e., when travel movement is stopped by the tool encountering the coating edge. The vibrational force applied to the coating 402 or 522, that is, the ultrasonic frequency force, can be much larger than the urging force—in the same manner that the well-known air impact hammer used for concrete pavement breaking and the like, exerts much larger forces on the concrete being broken than are exerted by the human operator or by gravity acting on the air hammer.

According to the present invention, the reciprocal or vibratory axial motion 412 in FIG. 4, is provided at ultrasonic vibration frequency, by the mechanical energy transducer 406 which may be of the piezoelectric crystal or alternatively of the magnetic flux (e.g., moving coil in a magnetic field) type, or of the pressurized fluid type. The transducer 406 in FIG. 4 and the tethering conductor 408 may be considered a generic representatious of any of these transducer types, however, an electrical transducer is to be preferred for convenience and control. In the case of an electrical to mechanical transducer 406, electrical energy of a suitable type is supplied from an energy conversion circuit apparatus 410 by way of a tethering flexible electrical conductor array 408 that connects the conversion circuit apparatus with the transducer 406.

The energy conversion circuit apparatus 410 in the case of an electrical-to-mechanical energy transducer at 406, may be of the type which employs an electronic oscillator circuit coupled to power amplifier transistors that are energized by an AC to DC conversion power supply.

The apparatus 410 is therefore an energy conversion circuit which in the electrical case rearranges the typical 60 Hz or 400 Hz electrical supply energy into the voltage, current and waveform desired for operating the selected transducer 406. In the case of a fluid-powered transducer at 406, the conversion apparatus 410 could, for example, include an air compressor, valves, modulators and other fluid flow control devices.

The square or blunt edge 414 and the sharpened edge 212 are, of course, two of the many possible shapes which may be employed is conveying the mechanical energy of the transducer to the protective coating. Among the desired properties for the tool and the edges 212 and 414 are the following: positive engagement with the protective coating being removed; sufficient mechanical strength and thermal resistance to withstand long periods of use; shape convenient for sharpening and reuse; minimal mass to be accelerated by the transducer 406; shaped as needed for compatibility with the surface being cleaned; compatibility with a sliding nominal energy transfer engagement with the aircraft surface 416—an engagement providing minimal friction, galling cutting, or other energy transfer. High carbon steels such as tool steel, carbide steel, or stainless steel or as indicated above, diamond, are preferred materials for use in the tools 204 and 404.

FIG. 5 in the drawings shows an arrangement of the invention varied from the FIG. 1 and FIG. 4 arrangements in several respects. In FIG. 5, the aircraft skin segment 500 is shown to be of an organic composition, such as the above-mentioned organic matrix composite which may include a woven fabric incorporating graphite and epoxy resin as major components. The protective coating used with this matrix composite skin surface, the coating 522, can be of a type similar to that used with the aluminum skin surface in FIG. 4. The coating in FIG. 5 is, however, presumed to be of a material or a physical state which results in ultrasonic energy removal of coating in pieces. This precisive removal is shown by the coating pieces at 536 and 538 and by the coating voided area 534. The coating types identified earlier herein are applicable to both FIG. 4 and FIG. 5 skin surfaces.

The tool 404 and the reciprocal or vibratory axial motion indication 412 in FIG. 5 are similar to the corresponding portions of FIG. 4. A transducer of the type described at 406 in FIG. 4 is also presumed in FIG. 5, but is not shown for the sake of drawing simplicity. The transducer employed in FIG. 5 may, of course, be of a different physical and energy output size than the transducer 406 in FIG. 4, in keeping with the machine feed and other differences in FIG. 5.

The FIG. 5 arrangement of the invention also includes a tool and work surface enclosure 524 which serves to provide a controlled atmosphere, indicated at 526, that is conducive to and assisting in removal of the protective coating 522. Communicating with the atmosphere 526, by way of a pair of ports 502 and 506 in the housing 524, is a flow of material 504 capable of assisting the tool 404 in removing the coating 522. The flow 504 may, for example, include a coolant fluid such as a refrigerant gas, e.g., nitrogen or carbon dioxide that has been changed from a liquid to a gas, a heating fluid such as hot air or steam, and/or a supply of abrasive material such as silicon carbide granules. A coating softening agent such as a water-based softener or a chemical solvent softener, may also be used in the flow 504. The residue from the flow 504, together with the removed portions of the coating 522 are intended to depart the enclosure 524 by way of the port 506, as is indicated by the exit flow 508. The flows 504 and 508 may, of course, be assisted by the addition of a pump or other flow-inducing apparatus known in the art.

The size of the enclosure 524 can be used to determine the lead time or soaking time access of the material supplied in the flow 504 to the coating 522 prior to coating engagement by the tool 540. Alternately, it may be desirable to pre-apply some materials of the flow 504 in a separate step or a separate enclosure from that used for the tool 540. Sealing of the enclosure 524 against leakage of the materials of the flow 504 is provided by the resilient members 518 attending the tool 404 and the resilient members 520 located at the junction of the enclosure 524 and the coating 522 and the aircraft surface 528. These resilient members allow movement of the tool 540 and movement of the enclosure 524 to occur while maintaining an effective seal of the enclosure 524.

Also included in the FIG. 5 apparatus is a pair of tension members 510 and 512, and a pair of rotatable reels 514 and 516 by which the tool 540 and the enclosure 524 can be moved over the surface 528 of the aircraft as removal of the protective coating 522 ensues. The reels and tension members 514, 516, 510 and 512 may, of course, be motor driven and may comprise part of a machine or automatic feed system which can also be closed-loop in nature and can thereby move the tool 404 in response to the progression of the coating removal process.

The reels and tension members may alternately be embodied in the form of a robotic device of the type used, for example, in the automative industry. With such a robotic system, wherein movement of the tool 540 and the enlosure 524 is accomplished by an extended multiply pivoted manipulative arm, as is represented by the arm end portion 542 and its attachment header and fastener 544 and 546 in FIG. 5. Robotic arms of this type are shown in the U.S. Patents of Flick, 3,618,786; Kiryu et al. 4,546,724; and Toutant et al, 4,604,715; which are hereby incorporated by reference herein.

Such arms can, of course, be arranged to respond to changes in the force urging the tool 404 into contact with the coating 522 in FIG. 5 and thereby maintains the tool in contact with the receding edge of the coating. The generated tool to coating urging force may be sensed using force sensor located in the arm mechanism, the transducer 406 or in the connection between transducer 406 and tool 504. A sensor capable of responding to this urging force is, for example, included in the Flick patent, see, for instance, the abstract and column 1, lines 6–7.

The desired robotic arm could also be arranged to respond to optical or infrared signal differences between reflections from the coating 402 and reflections from the coated surface in the voided area 534, as is shown in FIG. 5. In this instance, the arm is driven or programmed to close the void area 534 by moving the tool into contact with the coating 522 whenever the existence of a void area is detected. Detectors of this optical type are disclosed in the patent of J. Cornu et al, U.S. 4,413,910, which is hereby incorporated by reference herein and also in the above-identified Kiryu et al and Toutant patents. The fiber optic and reflected signal arrangement shown in the Toutant el al patent is especially adaptable to the sensing and movement needs of the FIG. 5 apparatus. An illumination source of either the visible or infrared type and a companion sensor are shown at 530 and 532 in FIG. 5; such devices may be mounted in a convenient location that is connected to the enclosure 524 or located remotely and connected optically to the enclosure 524 by fiber optic devices as taught in the Toutent patent. The FIG. 5 apparatus, of course, implies that the transducer which energizes the tool 540 is in some not shown way connected with the housing 524 and moved along with the housing 524 by the robotic arm 542 or the tension members 510 and 512.

The use of coolant or heating fluids in the material flow 504, of course, implies a temperature sensitive response by the coating 522, such a response is commonly encountered in the coating art. Many of the present-day coatings, for example, also become brittle and subject to ready fracture from energy received from a tool such as the tools 404 or 540 upon being chilled to below room temperature; such response is desirable and conducive to the coating removal-in-pieces arrangement shown in FIG. 5. Liquid nitrogen, cooled hydrocarbon solutions, or cooled liquids of the fluorinated hydrocarbon solvent type may therefore also be desirable for use in the flow 504, in addition to the previously recited refrigerant gases. Additionally, heating or chemical reactant fluids may provide a more removal-susceptible characteristic to the coating 522.

Figure 3:
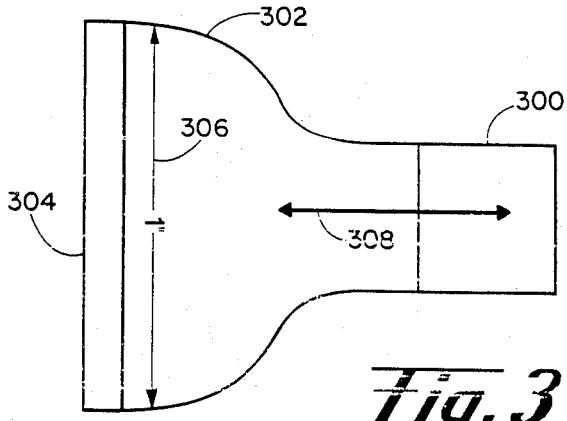
FIG. 3 shows additional details of a possible blade structure for the invention.

Two arrangements for the coating engagement tool are disclosed herein in FIG. 2 and in FIGS. 4 and 5; in each of these instances the tool is shown in cross-section or in a side view. A top or plan view of a tool suitable for use in the invention is also shown at 302 in FIG. 3 of the drawings with the direction of ultrasonic energization being indicated at 308. A tool width compatible with with the hundreds of watts of ultrasonic energy excitation described herein is indicated at 306 and a transducer engagement portion indicated at 300 in FIG. 3. The tool 302 may be connected to a transducer of the type shown at 406 in FIG. 4 by a gripping of the tool engagement portion 300 in a mating socket portion of the transducer with positive retention of the tool in the socket being accomplished by spring force or threaded arrangements that are known in the art. The coating engagement edge 304 of the tool 302 may be of either the FIG. 2 or FIGS. 4–5 type.

The shape of the working end of the tool 302 in FIG. 2 may be varied in accordance with the woven fabric nature of the aircraft skin segment 500 in order to achieve optimum coating removal with minimal skin surface damage. The movement frequency of the tool 302 in FIG. 3, the angle of tool application to the aircraft surface, the tool feeding and other similar variables are factors which can affect coating removal efficiency. Such variables can be finally fixed after a period of experience with a particular coating removal environment. Persons skilled in the coating removal art will appreciate that the fixation of all variables in advance of practical experience with a particular coating removal situation is undesirable, in other words, some flexibility is desired in arrangments such as shown in FIGS. 2, 4 and 5 to allow for individual conditions.

Figure 6:
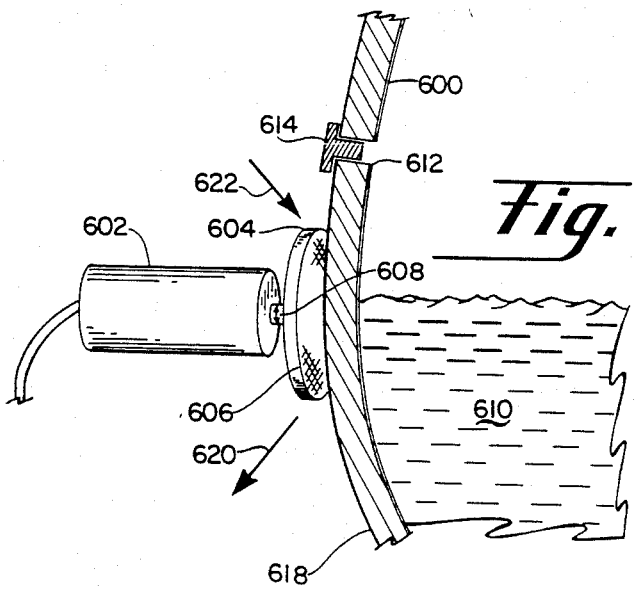
FIG. 6 shows another arrangement of the invention used in an aircraft related hazardous atmosphere location.

FIG. 6 in the drawings shows additional aspects of the invention including use of the coating removal apparatus in a hazardous atmosphere—as represented by the proximity of the aircraft fuel 610 and the fuel vent port 612 and vent port cover 614 to the coating removal site. In the FIG. 6 arrangement of the invention, the aircraft skin segment 600 may be a portion of the aircraft wing, for example, wherein the fuel tanks and tank venting arrangements normally reside. Since the described ultrasonic energy tranducers may be made free of the opening and closing of electrical contacts and electrical arcing, the FIG. 6 illustrated protective coating removal as well as the removal arrangement shown in FIGS. 1, 2, 4 and 5 herein may be practiced in hazardous combustion-susceptible atmospheres without danger of igniting fuel vapors or other flammable materials.

The FIG. 6 arrangement of the invention also employs reciprocating ultrasonic energy having lateral movement parallel to the surface 618 of the aircraft, as is indicated at 608. In the FIG. 6 arrangement of the invention, the tool 404 in FIGS. 4 and 5 is replaced with a substrate member 604 on which is disposed an abrasive coating 606. Ultrasonic transducers for use at 602 in FIG. 6 and capable of providing the lateral motion indicated at 608 are, of course, available in the commercial marketplace, and may also be of the piezoelectric crystal or magnetic or pressurized fluid type, as described above for the transducer 406. The substrate member 604 may be mated with the transducer 602 using a spring loaded or threaded attachment arrangement as are known in the art.

In the FIG. 6 arrangement of the invention, protective coating removal is accomplished by a rubbing, abrading or grinding action. In such a coating removal arrangement the addition of new abrasive material and the flushing of coating materials and other spent materials as described for the flow 504 in FIG. 5, and as indicated by the arrows 620 and 622 in FIG. 6 may be desirable.

The FIG. 6 arrangement of the invention may also be used as a supplement to the FIGS. 1, 2, 4 and 5 representations of the invention in order to achieve either polishing or smoothing of the underlying aircraft surface or final small quantity protective coating removal or initial pre-treatment of the coating to be removed. The FIG. 6 arrangement of the invention may also include an enclosure of the type shown at 524 in FIG. 5 in order to provide either a desired atmosphere 526 or a containment for spent materials.

The described invention therefore comprises the bringing together on a coated surface of ultrasonic energy agitation of a tool member, in combination with possible solvent or other coating conditioning agents abrasive materials and. Such a combination is a possible alternative to the abrasive blasting and chemical removal techniques which are currently employed on aircraft. The described invention may, of course, be used with other than aircraft equipment, and may be scaled upward and downward as to energy levels, tool sizes, and utilization times, as is appropriate to the coating material and area involved. The frequency of the ultrasonic energy used in the invention may be varied in the range of 20 kHz and upward, including presently available commercial equipment which operates in the 50 kHz range. The described protective coating removal arrangements are inherently environmentally and human-operator safe, a marked improvement over the presently-used chemical and abrasive blasting removal techniques.

It will be understood that the terms protective coating, coating, paint, and the like are used interchangeably herein without limitation of the invention.

While the apparatus and method herein described constitute a preferred embodiment of the invention, it is to be understood that the invention is not limited to this precise form of apparatus or method, and that changes may be made therein without departing from the scope of the invention, which is defined in the appended claims.

What is claimed is:

1. Vibratory mechanical energy apparatus for removing hardened tenacious polymeric resin coatings from the exterior of an aircraft with minimal damage to the smooth and fragile flight surfaces of the aircraft comprising the combination of:

a coating engagement tool member having a shaped working edge portion engageable in large kinetic energy transferring compression, impacting, scraping, and shearing relationships with a work area region of said aircraft polymeric coating and in low energy transferring sliding relationship with said smooth and fragile underlying aircraft flight surfaces;

a source of vibratory motion mechanical energy fixedly connected with said tool member and connected with an exciting source therefor, said vibratory motion mechanical energy source having an ultrasonic vibration frequency of at least twenty kilohertz and imparting movement at said frequency to said tool member along an axis having predetermined alignment with respect to said working edge portion thereof;

coating layer presence sensing means for sensing the absence of a coating immediately adjacent said working edge portion; and means responsive to for urging said tool member working edge into moving continuing travel contact with a receding removed coating edge of said polymeric coating as removal progresses.

2. The apparatus of claim 1 wherein said tool and said aircraft surface are separated by an angle between five and twenty-five degrees in size.

3. The apparatus of claim 1 wherein said portable source of vibratory motion mechanical energy includes a piezoelectric crystal.

4. The apparatus of claim 1 wherein said portable source of vibratory motion mechanical energy includes a moving coil electromagnetic transducer.

5. The apparatus of claim 1 wherein said portable source of vibratory motion mechanical energy includes a pressurized fluid transducer.

6. The apparatus of claim 1 wherein said means urging said tool member working edge portion into coating contact includes tension members and rotatable reel members.

7. The apparatus of claim 1 wherein said means urging said tool member working edge portion into contact includes a servo controlled robotic arm.

8. The apparatus of claim 1 wherein said working edge has a squared cross-sectional shape.

9. The apparatus of claim 1 wherein said working edge includes a tapered cross-sectional shape terminating in a sharpened edge.

10. The apparatus of claim 9 wherein said sharpened working edge tool member is disposed at an angle of five to twenty-five degrees with respect to he plane of said aircraft surface.

11. Protective coating removal apparatus for a physical damage susceptible workpiece surface covered with a coating layer to be removed comprising:

transducer means for generating reciprocal motion mechanical energy of at least twenty kilohertz ultrasonic movement frequency;

a coating engagement tool physically connectable with a mechanical energy output portion of said energy transducer means at one tool end and receivable at the opposite tool end on said damage susceptible workpiece surface in ultrasonic energy transferring mechanical engagement with said coating layer and in sliding relationship with said workpiece surface;

coating layer presence sensing means for sensing the absence of coating immediately adjacent said working edge portion;

moving means responsive to for moving said ultrasonic frequency mechanical energy excited coating engagement tool over the surface of said workpiece in engagement with successive portions of said coating layer.

12. The apparatus of claim 11 wherein said energy transducer means has a power input level exceeding one hundred watts.

13. The apparatus of claim 11 further including fluidized coating conditioning media received on said coating layer prior to engagement by said tool.

14. The apparatus of claim 13 wherein said coating conditioning media comprises an organic solvent chemical reactant.

15. The apparatus of claim 11 wherein said means for moving said coating engagement tool includes a programmed robot.

16. The apparatus of claim 11 further including means for controlling the temperature of said paint coating during said energy transferring mechanical engagement.

17. The apparatus of claim 16 wherein said means for controlling the temperature of said paint coating includes means for decreasing the temperature of said paint coating below room temperature.

18. The apparatus of claim 11 wherein said said reciprocal motion mechanical energy has amovement amplitude of one-thousandth of an inch or less.

19. The apparatus of claim 1 wherein said sensing means senses tool travel resistance force.

20. The apparatus of claim 1 wherein said sensing means senses the optical energy reflective difference between said coating and said aircraft surface.

* * * * *